United States Patent [19]

McMinn, Jr.

[11] 4,253,986

[45] Mar. 3, 1981

[54] AMMONIA SYNTHESIS GAS PRODUCTION

[75] Inventor: Talmage D. McMinn, Jr., Des Peres, Mo.

[73] Assignee: Monsanto Company, St. Louis, Mo.

[21] Appl. No.: 69,942

[22] Filed: Aug. 24, 1979

[51] Int. Cl.[3] ..... C10K 1/02

[52] U.S. Cl. ..... 252/373; 252/376

[58] Field of Search ..... 252/373, 376

[56] References Cited

U.S. PATENT DOCUMENTS

| | | | |
|---|---|---|---|
| 3,573,224 | 3/1971 | Strelzoff et al. | 252/376 |
| 3,993,583 | 11/1976 | Seglin | 252/373 |

*Primary Examiner*—A. Siegel

*Attorney, Agent, or Firm*—Paul L. Passley; J. C. Logomasini; Stanley M. Tarter

[57] ABSTRACT

Ammonia synthesis gas is prepared by contacting coal with air and steam in a fluidized bed. Heat for the reaction is provided by downward flowing hot thermal refractory material through the fluidized bed. The refractory material is heated externally of the fluidized bed by combustion of fuel. Control of the ratio of steam and air to the coal provides a gasification product of approximately 3 moles carbon monoxide plus hydrogen per mole of nitrogen.

15 Claims, 1 Drawing Figure

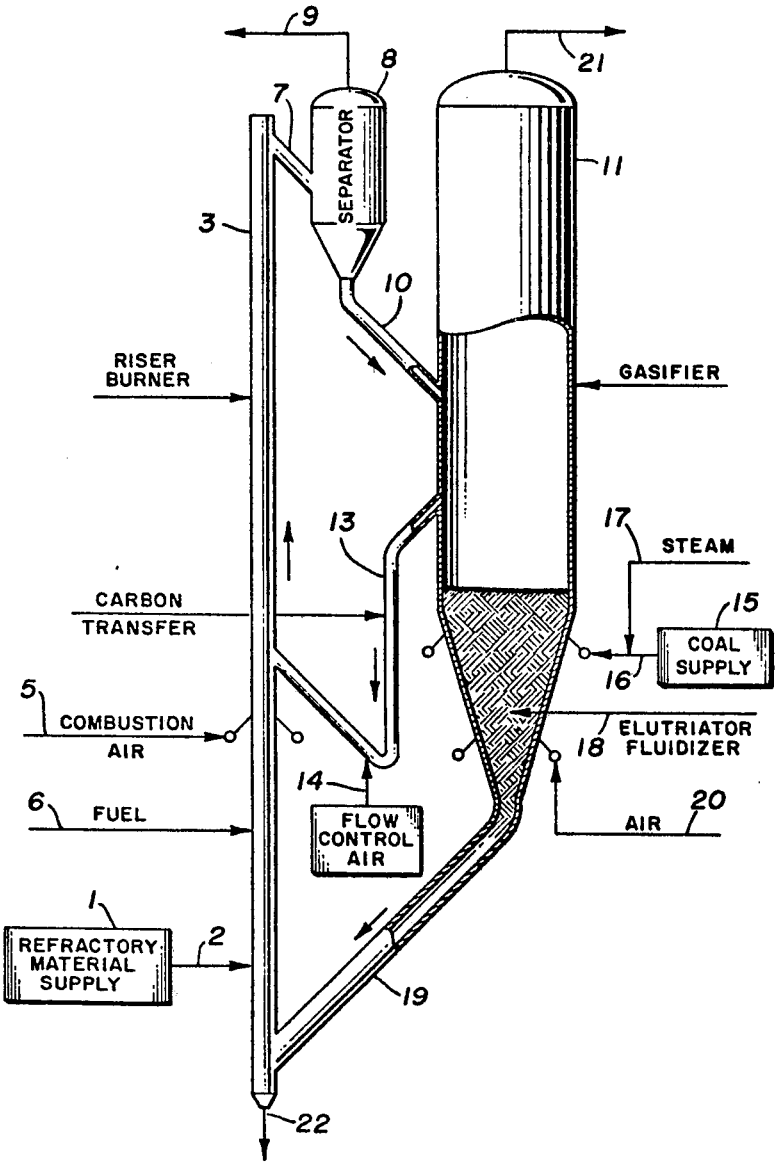
9
8
21
7
SEPARATOR
11
3
10
RISER
BURNER
GASIFIER
13
17
STEAM
CARBON
TRANSFER
15
COAL
SUPPLY
16
5
COMBUSTION
AIR
ELUTRIATOR
FLUIDIZER
18
14
6
FUEL
FLOW
CONTROL
AIR
20
AIR
1
REFRACTORY
MATERIAL
SUPPLY
2
19
22

AMMONIA SYNTHESIS GAS PRODUCTION

BACKGROUND OF THE INVENTION

This invention relates to the production of a mixture of hydrogen and nitrogen from solid carbonaceous materials and air. Ammonia synthesis gas is such a mixture having a molecular ratio of about 3 hydrogen to 1 nitrogen.

Ammonia synthesis gas is generally prepared by two-stage steam reforming of natural gas, with air in the correct proportion being introduced between stages. The air is introduced to provide nitrogen; however, combustion of part of the synthesis gas reduces the heat necessary to drive the endothermic reforming reaction to completion. This system produces an intermediate synthesis gas containing hydrogen, carbon monoxide and nitrogen, with the carbon monoxide plus hydrogen being approximately three times the moles of nitrogen. This gas is then catalytically reacted with steam in the so-called water gas shift reaction. In this well-known reaction, carbon monoxide reacts mole for mole with steam to produce one mole of hydrogen per mole of carbon monoxide. Thus, in a hydrogen-carbon monoxide mixture, carbon monoxide can be viewed as "potential" hydrogen. After the shift reaction, the gas is processed to remove water, carbon dioxide, and any traces of sulfur which may have been introduced in the hydrocarbon feed, resulting in a gas containing only hydrogen and nitrogen in the desired ratio.

With the decreasing reserves of natural gas, it has become apparent that other carbonaceous raw materials will ultimately be used in the manufacture of ammonia, methanol, and other synthesis gas derived products. Coal can be reacted with oxygen and steam to produce a mixture of hydrogen and carbon monoxide with minor amounts of carbon dioxide and sulfur compounds. If ammonia synthesis is the object of the gasification, the mixture is shifted and purified to produce pure hydrogen, after which an appropriate amount of nitrogen derived from air separation is blended with the purified hydrogen. A number of physical systems have been proposed to effect oxygen fueled gasification; however, generally they require an air separation plant or a purchased supply of pure oxygen. This adds to the capital cost and operating complexity; or, if purchased oxygen is used, the raw material costs chargeable to the product are greatly increased.

U.S. Pat. No. 2,795,559 discloses the production of a gas mixture of 3 volumes of hydrogen per volume of nitrogen by oxidatively gasifying a carbonaceous fuel, such as coal, with air as the sole source of oxygen at an elevated temperature and pressure to produce a synthesis gas containing a mixture of carbon monoxide, hydrogen and nitrogen, the latter being present in greater than one volume of nitrogen per three volumes of hydrogen. The carbon monoxide in said mixture is then reacted with steam, i.e., water gas shift reaction, to convert the carbon monoxide to carbon dioxide with the concomitant production of hydrogen. The carbon dioxide and water vapor are removed from the mixture leaving essentially a hydrogen and nitrogen mixture. The hydrogen and nitrogen mixture is then further refined by a series of steps wherein nitrogen in excess of 1 volume per 3 volumes of hydrogen is condensed at cryogenic conditions and removed to obtain the ammonia syn gas mixture. It is noted that the process described in this patent utilizes air in the gasification of the coal as the only source of oxygen and the reaction of air with the fuel, coal, is exothermic to maintain the gasification autogenously and supply heat for the endothermic water gas shift reaction.

U.S. Pat. No. 2,276,343 describes a continuous process for gasifying lignite to produce hydrogen by preheating a lignite containing 25–40% water to drive off water-containing vapor and render the lignite highly reactive. The mixture of highly reactive lignite and water vapor are reacted at an elevated temperature to produce a hydrogen rich gaseous mixture which is then separated from the lignite and purified. The lignite is heated and maintained at 500° C. to 850° C. in the described process by external means. External steam may be introduced to the reaction to produce additional hydrogen.

U.S. Pat. No. 3,620,697 discloses a process for producing hydrogen by reacting carbon, such as coal, with water utilizing a circulating inert particulate material as the heat source for the endothermic reaction. The inert particulate material is heated by burning a carbonaceous material therewith while being conveyed to the reaction. Similarly, U.S. Pat. No. 3,968,052 and U.S. Pat. No. 3,850,839 disclose processes for gasifying coal-derived char with steam in a fluid bed system where the heat for the endothermic gasification reaction is supplied by circulating through the system inert pellets which are heated by burning fines from the gasifier in their presence externally of the gasifier.

SUMMARY

This invention provides a unified process for producing a raw gaseous product which is readily converted to gas suitable for conversion to ammonia from solid carbonaceous starting materials. This gas, as derived from the teaching of this invention, contains essentially carbon monoxide plus hydrogen and nitrogen with hydrogen plus carbon monoxide in a molar ratio to nitrogen of about three to one. In this process, a chemically inert, thermally refractory solid particulate material is used to supply endothermic heat for oxidatively gasifying solid carbonaceous material with air and steam. In a major aspect of this invention, the solid carbonaceous material is maintained in a fluidized reaction zone and the heated inert solid particles flow downward through the fluidized bed losing heat to the reaction mass as they progress downward.

Typical objects of this invention are (1) to provide a process for gasifying solid carbonaceous materials, (2) to provide a process for production of crude ammonia synthesis gas comprising hydrogen plus carbon monoxide and nitrogen in a desired ratio, and (3) to provide an improved process for the gasification of solid carbonaceous materials with air and steam to form a gaseous mixture of about 3 volumes of carbon monoxide plus hydrogen and 1 volume of nitrogen.

Various other objects, aspects and advantages of this invention will become apparent to those skilled in the art from the accompanying description, drawings, and appended claims.

According to this invention, solid carbonaceous materials, as typified by coal of rank ranging from lignite through anthracite, are gasified by partial oxidation in the presence of steam. Partial oxidation in this context refers to oxidation of carbon, or a carbon-hydrogen material with a deficiency of oxidant, usually oxygen, so that the highest oxidation products cannot be obtained.

Thus, at the temperatures employed in this invention, the oxidized carbon would exist essentially as carbon monoxide rather than carbon dioxide and hydrogen would be essentially non-oxidized. The overall reaction of solid carbonhydrogen materials with steam and a deficiency of air is endothermic; that is, heat must be supplied to maintain the reaction at a temperature necessary to obtain desired products. The amount of heat supplied is a function of the heat of formation of the carbonaceous materials and the temperature(s) at which the various reactants are introduced into the reaction zone. A primary aspect of this invention is the use of a chemically inert, thermally refractory particulate solid to carry heat from a heating device outside the reactor into the reaction zone. This invention embodies a fluidized bed reactor consisting of a primary gasification zone of a vertically cylindrical section immediately above and contiguous to an elutriation/fluidization zone of a circular conical section. Solid carbonaceous particles entrained in the reactant steam are injected into the fluidized bed of particles at the bottom of the cylindrical section. In the fluidized bed operation mixing and thermal equilibrium are rapidly attained; thus, the solid carbonaceous particles are very rapidly heated to temperature and react with steam and air which is introduced as an elutriation/fluidization gas near the base of the conical section. As has been previously discussed, the solid carbonaceous material-air-steam reaction conducted in a deficiency of air is endothermic. The heat carrier particles, heated to a temperature above the reaction temperature, are introduced near the top of the gasification zone and are cooled rapidly to bed temperature while supplying heat necessary to maintain the reaction temperature. The quantity of heat carrier particles and temperature at which they are introduced into the bed are directly related to the heat required to maintain bed temperature and optimized conditions can readily be calculated from heat balance relations for a specific solid carbonaceous material. As the heat carrier particles reach the conical section, the cross-sectional area available for solids flow downward and gas flow upward decreases with the result that the smaller, lighter solid carbonaceous particles are, for the most part, blown back into the gasification zone while the heat carrier particles flow from the bottom of the elutriation/fluidization zone into a conduit leading to a riser-burner. The heat carrier particles, after removal of aggregates of ash, carbon and heat carrier, singly or in concert, flow up the riser-burner due to a pressure balance to the point where preheated combustion air is introduced, engages the particles and transports them on up the riser-burner. Immediately above the combustion air inlet, a stream of coal char, essentially pure carbon with a small amount of ash from the gasification zone, is fed into the riser-burner as additional fuel to the char entrained in the heat carrier particles from the elutriation/fluidization zone. Combustion of the fuel supplies heat to the heat carrier particles for ultimate release into the gasification zone. Heat carrier particles plus gas flow to a separator where the disengaged particles then flow back to the gasification zone, thus completing this cycle, while the combustion gas, nitrogen plus carbon dioxide are cooled to recover heat, filtered of particles by auxiliary equipment and are discharged harmlessly to the atmosphere.

Suitable conditions employed for carrying out this process can be generally typified as follows:

| | FROM | TO | PREFERRED |
|---|---|---|---|
| Superficial gasification velocity, feet per sec. | 1 | 5 | 2–3 |
| Superficial elutriation gas velocity, feet per sec. at bottom of cone | 4 | 10 | 6–7 |
| Superficial riser-burner gas velocity, feet per sec. | 12 | 40 | 18–22 |
| Reactor Temperature, °C. | 925 | 1200 | 1000 |
| Riser-Burner Temperature °C. | 1050 | 1300 | 1150 |
| System Pressure, atmospheres | 1 | 65 | 28–32 |

The ratio of air and steam to solid carbonaceous material in the gasifier feed will depend entirely on the elemental analysis of the coal to obtain the 3/1 molar ratio of carbon monoxide plus hydrogen to nitrogen which will generally be desired. Generally, a weight ratio of 0.25 to 0.75 lbs. $H_2O$/lb. coal is present in the gasifier and a weight ratio of 0.6 to 10 lbs. air/lb. coal is present in the elutriation/fluidization zone. Also, solid carbonaceous solids, e.g., coals of various ranks, are not of uniform composition even in a given mine. Regulation of the process can be accomplished by air-steam-coal ratio control based on continuous analysis of the gas product. Although a molar ratio of 3 hydrogen to 1 nitrogen is desirable for ammonia synthesis gas, a broad molar ratio of carbon monoxide plus hydrogen to nitrogen such as 2:1 to 4:1 can be prepared in accordance with this invention by varying the steam and/or air additions. Additional hydrogen or nitrogen may be added to bring the ratio of 3 to 1 for ammonia synthesis.

In the preferred method of operation of the various zones, a chemically inert thermally refractory particulate solid material is continuously circulated through the reaction system. Throughout the system linear gas velocities are maintained such that the inert material is entrained in the gases in the riser-burner zone and flows downward through the fluidized bed of solid carbonaceous material in the gasifier and elutriation zones. Gas velocities of 12 to 40 feet per second are employed in the riser-burner zone and 1 to 5 feet per second in the gasifier zone and 4 to 10 feet per second in the elutriation zone. Actual gas velocities employed will be dependent upon the apparatus, size and shape, employed and the densities of the solid materials. In this type of operation, means will be provided externally of the gasification zone for separating solid materials entrained in the gaseous effluent withdrawn from the gasifier zone.

Any chemically inert material capable of being a heat carrier is usable in the present invention. The heat carrier will generally be used in a particulate form of a size suitable for fluidization. Any refractory metal oxide such as aluminum oxide, silica-aluminum oxide, spinels, zirconia, mullite and the like can be used as the inert material.

The temperature employed in the gasification zone can vary over a wide range. Preferably, such reaction will be conducted from 925° C. to 1200° C. Pressure on the system can also vary. The system can be operated under pressures from 0 psig to 1000 psig. Temperatures in the riser-burner zone will generally be from 1050° C. to 1300° C.

As previously indicated, the process of this invention utilizes a fluidized bed of solid carbonaceous material in the gasifier zone. The fluidization of the solids is obtained by introducing air, also a reactant, into the system. Air is introduced at such rates to fluidize the solids.

This invention will be more specifically described with reference to the drawings. FIG. 1 is a diagrammatic illustration of the apparatus in the system described with regard to gasifying coal.

According to FIG. 1, chemically inert, thermally refractory material in particulate form, as needed, from supply 1 is introduced through conduit 2 to riser-burner zone 3. Combustion air is introduced through conduit 5 into the lower portion of riser-burner zone 3. Riser-burner zone 3 is maintained under conditions whereby the inert particles are heated. In one aspect heat is supplied by burning fuel introduced through conduit 6. In another aspect heat is supplied by burning carbon from gasifier zone 11, introduced through conduit 13 to riser-burner zone 3. Air is introduced into conduit 13 through conduit 14 to control movement of the carbon therethrough. The exothermic burning reaction heats the inert particles. The inert particles are transported upwardly through riser-burner zone 3 through conduit 7 into gas-solids separator 8. Combustion gases are removed through conduit 9 and vented. The heated inert particulate material flows through conduit 10 into gasifier zone 11. Coal from supply 15 is introduced through conduit 16 to gasifier 11. Steam is introduced through conduit 17 into conduit 16 to transport the coal therethrough and introduce steam to gasifier 11. Below gasifier 11 is elutriation/fluidization zone 18 where the inert particulate material after flowing downward through the bed of coal in gasifier zone 11 is separated from the coal derived char and flows from elutriation/fluidization zone 18 through conduit 19 into the lower portion of riser-burner 3. Air is introduced through conduit 20 into the lower portion of elutriation/fluidization zone 18 to aid in separation of the inert particulate material and char and to fluidize the bed of and react with coal in gasifier 11. Gasification product gases are removed from the upper portion of gasifier 11 through conduit 21 for further processing and recovery of ammonia synthesis gas.

The practice of this invention will now be more fully illustrated in the following Examples.

EXAMPLE 1

In this Example, the reactor employed for carrying out coal gasification comprises a 20-inch RA 330 schedule 40 pipe with a 1.61-inch inside diameter main having a Type 310 stainless steel conical section at the bottom fitted with a water-cooled injection nozzle through which 0.539 gram per minute of finely divided Kentucky bituminous coal conveyed with 0.250 standard liters per minute of air are introduced. The reactor contains 195 grams of alpha aluminum oxide to provide a fluidized bed height of 18 inches. The reactor is equipped with two dip tubes, one extending from the top through the inert material to about ¼ inch above the coal/air injection nozzle through which 0.250 gram per minute of steam is introduced and the other extends to the top of the fluidized bed for removal of reaction gases and excess solids (ash and unreacted coal). The reactor is enclosed in an insulated electric radiant heater. The reaction is conducted at 1051° C., a pressure of 1 atmosphere absolute and a gas residence time of 10.1 seconds for 120 minutes. Characterization of the feed and product is as follows:

| ANALYSIS | | | |
|---|---|---|---|
| FEED (wt. %) | | PRODUCT (grams/moles) | |
| C | 68.61 | C | 2.58 |
| H | 5.25 | $O_2$ | 0.02 |
| N | 1.39 | $N_2$ | 1.15 |
| S | 0.70 | $CO_2$ | 0.06 |
| O | 9.56 | CO | 1.52 |
| $H_2O$ | 2.82 | $H_2$ | 1.92 |
| Ash | 11.67 | | |

The product gas contains a molar ratio of $CO+H_2$ to $N_2$ of 2.99, which after water gas shift of the CO provides a $H_2/N_2$ mixture suitable for ammonia synthesis.

EXAMPLE 2

This Example, with reference to the drawing of FIG. 1 illustrates the continuous stable gasification of Kentucky bituminous coal according to this invention. Additions to or modifications of flows and conditions during periods of non-steady state operation will be apparent to those skilled in the art. These periods include transient conditions to start-up and shut-down as well as inevitable upsets caused by changing feedstock and/or production rates imposed by operations of auxillary equipment necessary to, but not integral with this invention. Further, ancilliary equipment necessary to the operation of a process utilizing this invention, but not germane to the invention as disclosed here include heat exchangers, compressors, coal handling and conditioning equipment, solids conveying equipment, and gas-solids separators.

Powdered coal, 2.1 grams per minute is fed via conduit 16 where it is joined by 0.73 grams per minute steam at 500 psig and 350° C. from conduit 17 which pneumatically conveys the coal to the lower portion of the fluidized bed in gasifier 11. The coal is very rapidly heated to the reaction temperature, 1025° C. in the fluidized bed and reacts with 2.04 grams per minute (1.59 standard liters per minute) of air preheated to 825° C. fed via conduit 20 and the conveying steam to produce 0.235 gram mole per minute (5.27 standard liters per minute) of a gas containing 41.3 mole percent hydrogen, 32.4 mole percent carbon monoxide, 24.6 mole percent nitrogen, and 1.7 mole percent carbon dioxide. Traces of hydrogen sulfide will also be formed if the coal contains sulfur impurities. The raw synthesis gas exits the reactor through conduit 21 and is processed by downstream equipment, not shown, to recover heat, preheating incoming air, remove sulfur, entrained ash, and carbon particles, and further chemical reaction. The reaction, with coal entering at 25° C., steam at 325° C. and air entering at 825° C. is endothermic requiring heat to be supplied at the rate of 3.07 kilocalories per minute. This endothermic heat requirement is supplied by a flow of a chemically inert thermally refractory heat carrier typified by alpha aluminum oxide of a size suitable for fluidization. The heat carrier is introduced near the top of the fluidized bed of coal char in the gasifier 11 from riser-burner 3 and separator 8 through conduit 10 at a rate of 102 grams per minute and a temperature of 1125° C. The heat carrier passes downward through the fluidized bed by virtue of its particle size and density rapidly giving up heat to maintain bed temperature at 1025° C. The heat carrier is essentially separated from carbon in the conical lower section of gasifier 11 by elutriation in the incoming air and leaves the reactor at a temperature of 1025° C. via standpipe 19. Any large, relative to the heat carrier particles, particles of coal are trapped at the bottom of the riser-burner 3 and intermittently removed via conduit 22. Combustion air, 5.41 grams per minute (4.21 standard liters per minute) at 825° C. is introduced through conduit 5, and transports the heat carrier upward in riser-burner 3 where it is heated from 1025° C. to 1125° C. by combustion of 0.45 gram of carbon per minute fed into the riser-burner 3 from the gasifier 11 via conduit 13 with the rate being controlled by very small amounts of aeration air flowing through conduit 14. The mixture of hot combustion gas and reheated heat carrier is separated in separator 8 with solids being returned to the gasifier 11 via conduit 10 and 0.188 gram mole per minute (4.21 standard liters per minute) of flue gas leaving the separator through conduit 9 for heat recovery and cleanup before being vented to the atmosphere.

What is claimed is:

1. A continuous process for the gasification of solid carbonaceous materials in a fluidized bed system comprising a lower elutriation/fluidization zone and an upper gasifier zone and an associated riser-burner zone which comprises:

(a) introducing particulate solid carbonaceous material and steam into the lower portion of said gasifier zone, (b) introducing air into the lower portion of said elutriation/fluidization zone, (c) entraining and fluidizing said particulate solid carbonaceous material in said air, (d) introducing a finely-divided chemically inert, thermally refractory solid material at an elevated temperature into the upper portion of said gasifier zone, (e) allowing said inert solid material to flow downward through said fluidized bed of solid carbonaceous carbon material in said gasifier zone, (f) maintaining said gasifier zone under conditions so that said carbonaceous material, steam and air are endothermically reacted to a mixture of carbon monoxide, hydrogen and nitrogen, (g) said inert solid material being the source of heat for said endothermic reaction, (h) withdrawing a gaseous effluent comprising carbon monoxide, hydrogen and nitrogen from the upper portion of said gasifier zone, (i) separating said inert solid material from said solid carbonaceous material in said elutriation/fluidization zone, (j) withdrawing said separated inert solid material from said elutriation/fluidization zone and removing ash containing particles therefrom, (k) introducing said separated ash poor inert solid material into the lower portion of said riser-burner zone, (l) introducing air and fuel to the lower portion of said riser-burner zone, (m) maintaining exothermic conditions by burning said fuel in said riser-burner zone to heat said ash poor inert solid material to an elevated temperature sufficient to effect gasification of said solid carbonaceous material in said gasifier zone, and (n) withdrawing said heated inert ash poor solid material from said riser-burner zone and reintroducing it into said gasification zone.

2. The process of claim 1 wherein said solid carbonaceous material is coal.

3. The process of claim 2 wherein said coal is a coal of rank ranging from lignite through anthracite.

4. The process of claim 3 wherein said coal is lignite.

5. The process of claim 1 wherein said chemically inert thermally refractory solid material is alpha alumina.

6. The process of claim 1 wherein said chemically inert thermally refractory solid material is silica-alumina.

7. The process of claim 1 wherein said chemically inert thermally refractory solid material is spinel.

8. The process of claim 1 wherein the temperatures maintained in said gasifier zone is from 925° C. to 1200° C. and in said riser-burner zone is 1050° C. to 1300° C.

9. The process of claim 1 wherein said gaseous effluent contains carbon monoxide plus hydrogen to nitrogen in a molar ratio of 2 to 1 to 4 to 1.

10. The process of claim 1 wherein the superficial gas velocity in the gasifier zone is 1 to 5 feet per second, in the elutriation/fluidization zone is 4 to 10 feet per second and in the riser-burner zone is 12 to 40 feet per second.

11. A continuous process for the gasification of coal in a fluidized bed system comprising a lower elutriation-fluidization zone and an upper gasifier zone and an associated riser-burner zone which comprises:

(a) introducing particulate coal selected from the group consisting of lignite, bituminous, sub-bituminous and anthracite and steam at a weight ratio of 0.25 to 0.75 lbs. $H_2O$/lb. coal into the lower portion of said gasifier zone, (b) introducing air to provide an air to coal weight ratio of 0.6 to 10 lbs. air/lb. coal into the lower portion of said elutriation/fluidization zone at a rate to provide a superficial gas velocity of 4 to 10 ft./sec. in said elutriation/fluidization zone and of 1 to 5 ft./sec. in said gasifier zone to entrain and fluidize said particulate coal, (c) introducing a finely-divided chemically inert, thermally refractory solid material at a temperature of 1050° C. to 1300° C. into the upper portion of said gasifier zone, (d) allowing said inert solid material to flow downward through said fluidized bed of coal in said gasifier zone to maintain said gasifier zone at a temperature of 925° C. to 1200° C. so that said coal, steam and air are endothermically reacted to form a mixture of carbon monoxide, hydrogen and nitrogen, said inert solid material being the source of heat for said endothermic reaction, (e) withdrawing a gaseous effluent comprising said mixture of carbon monoxide, hydrogen and nitrogen from the upper portion of said gasifier zone, (f) separating said coal from said inert solid material by elutriation with said air introduced to said elutriation/fluidization zone, (g) withdrawing said separated inert solid material from said elutriation/fluidization zone and removing ash containing particles therefrom, (h) introducing said separated ash poor inert solid material into the lower portion of said riser-burner zone, (i) introducing air and fuel to the lower portion of said riser-burner zone, sufficient to burn said fuel to heat said inert solid material to a temperature of 1050° C. to 1300° C., and (j) withdrawing said heated inert solid material from said riser-burner zone and reintroducing it into said gasification zone.

12. The process of claim 11 wherein said chemically inert thermally refractory solid material is alpha alumina.

13. The process of claim 11 wherein said chemically inert thermally refractory solid material is silica-alumina.

14. The process of claim 11 wherein said chemically inert thermally refractory solid material is spinel.

15. The process of claim 11 wherein said gaseous effluent contains carbon monoxide plus hydrogen to nitrogen in a molar ratio of 2 to 1 to 4 to 1.

* * * * *